US009268356B2

(12) United States Patent
Burleson

(10) Patent No.: US 9,268,356 B2
(45) Date of Patent: Feb. 23, 2016

(54) MODULAR KNOB SYSTEM

(71) Applicant: TOUCHSENSOR TECHNOLOGIES, LLC, Wheaton, IL (US)

(72) Inventor: Mark Burleson, Elburn, IL (US)

(73) Assignee: TOUCHSENSOR TECHNOLOGIES, LLC, Wheaton, IL (US)

( * ) Notice: Subject to any disclaimer, the term of this patent is extended or adjusted under 35 U.S.C. 154(b) by 0 days.

(21) Appl. No.: 13/839,397

(22) Filed: Mar. 15, 2013

(65) Prior Publication Data

US 2014/0260776 A1 Sep. 18, 2014

(51) Int. Cl.

| | |
|---|---|
| ***G05G 1/10*** | (2006.01) |
| ***G05G 1/08*** | (2006.01) |
| ***G05G 5/06*** | (2006.01) |

(52) U.S. Cl.

CPC .. *G05G 1/10* (2013.01); *G05G 1/08* (2013.01); *G05G 5/06* (2013.01); *Y10T 74/2084* (2015.01)

(58) Field of Classification Search

CPC ..... G05G 1/10; G05G 1/08; H01H 19/14; H01H 2003/105; H01H 2019/008

USPC ..... 74/553, 527, 473.21; 42/122; 200/4

See application file for complete search history.

(56) References Cited

U.S. PATENT DOCUMENTS

| | | | | |
|---|---|---|---|---|
| 3,447,385 | A * | 6/1969 | Humphreys | 74/10.5 |
| 3,517,570 | A * | 6/1970 | Kolb | 74/527 |
| 3,909,878 | A | 10/1975 | Natinsky | |
| 5,613,600 | A | 3/1997 | Yokoji et al. | |
| 5,862,715 | A * | 1/1999 | Lemire | 74/553 |
| 6,188,332 | B1 | 2/2001 | Scarlata | |
| 6,281,453 | B1 | 8/2001 | Uleski | |
| 6,642,824 | B2 * | 11/2003 | Oomkes | 335/207 |
| 6,843,356 | B2 | 1/2005 | Oster | |
| 6,927,351 | B2 | 8/2005 | Ashton | |
| 7,211,755 | B1 | 5/2007 | Wang et al | |
| 7,251,861 | B2 * | 8/2007 | Suzuki | 16/441 |
| 7,255,020 | B2 | 8/2007 | Thomeczek et al. | |
| 7,579,559 | B2 | 8/2009 | Schelbert et al. | |
| 7,714,242 | B2 | 5/2010 | Ishigaki et al. | |
| 7,745,749 | B2 | 6/2010 | Ito | |
| 7,908,713 | B2 * | 3/2011 | Yoshinaka et al. | 16/441 |
| 7,987,738 | B2 | 8/2011 | Kaps et al. | |
| 8,013,847 | B2 | 9/2011 | Anastas | |
| 8,051,740 | B2 * | 11/2011 | Giefer et al. | 74/473.21 |
| 8,516,736 | B2 * | 8/2013 | Windauer | 42/122 |

(Continued)

FOREIGN PATENT DOCUMENTS

| | | | | |
|---|---|---|---|---|
| DE | 102008045232 | | 3/2010 | |
| EP | 2687936 | | 1/2014 | |
| GB | 2 130 438 A | * | 5/1984 | G05G 1/10 |
| JP | 5-150851 | * | 6/1993 | 74/553 |

OTHER PUBLICATIONS

English Abstract of JP 5-150851, Yosuke et al., Jun. 1993.* merriam-webster.com/dictionary/resilient; May 10, 2005.*

International Search Report and Written Opinion issued in Int'l Patent Application No. PCT/US2014/030227, dated Jun. 30, 2014.

*Primary Examiner* — Vinh Luong

(74) *Attorney, Agent, or Firm* — Barnes & Thornburg LLP

(57) ABSTRACT

Embodiments of a modular knob system include a modular knob shell, bearing componentry, and detent componentry. A specific knob shell embodiment may accommodate various different detent mechanisms so that a single knob shell can be used with numerous switching mechanisms. The knob system also may include electronic, magnetic or other sensors.

16 Claims, 14 Drawing Sheets

(56) References Cited

U.S. PATENT DOCUMENTS

| | | | | |
|---|---|---|---|---|
| 2006/0096845 | A1 | 5/2006 | Zegula | |
| 2009/0009491 | A1 | 1/2009 | Grivna | |
| 2009/0015360 | A1* | 1/2009 | North et al. | 335/209 |
| 2009/0046054 | A1* | 2/2009 | Olien | 345/156 |
| 2010/0084249 | A1* | 4/2010 | Bandy et al. | 200/4 |
| 2010/0108476 | A1* | 5/2010 | Trudeau et al. | 200/14 |
| 2010/0200384 | A1 | 8/2010 | Tsuduki | |
| 2010/0231506 | A1 | 9/2010 | Pryor | |
| 2010/0242548 | A1* | 9/2010 | Webster | G06F 39/005 68/139 |
| 2012/0247934 | A1* | 10/2012 | Schmidt et al. | 200/336 |
| 2013/0220779 | A1* | 8/2013 | Kerner | H01H 19/11 200/4 |

* cited by examiner

MODULAR KNOB SYSTEM

BACKGROUND AND SUMMARY

The present disclosure illustrates several exemplary embodiments of modular knob systems configured to provide haptic feedback to a user. The modular knob systems can be used in connection with a touch sensor to provide a solid state rotary switching mechanism with haptic feedback. The modular knob systems can be used in connection with touch sensors, for example, capacitive sensors and field effect sensors, as well as with magnetic sensors and other solid state sensors.

DETAILED DESCRIPTION OF THE DRAWINGS

Figure 1:
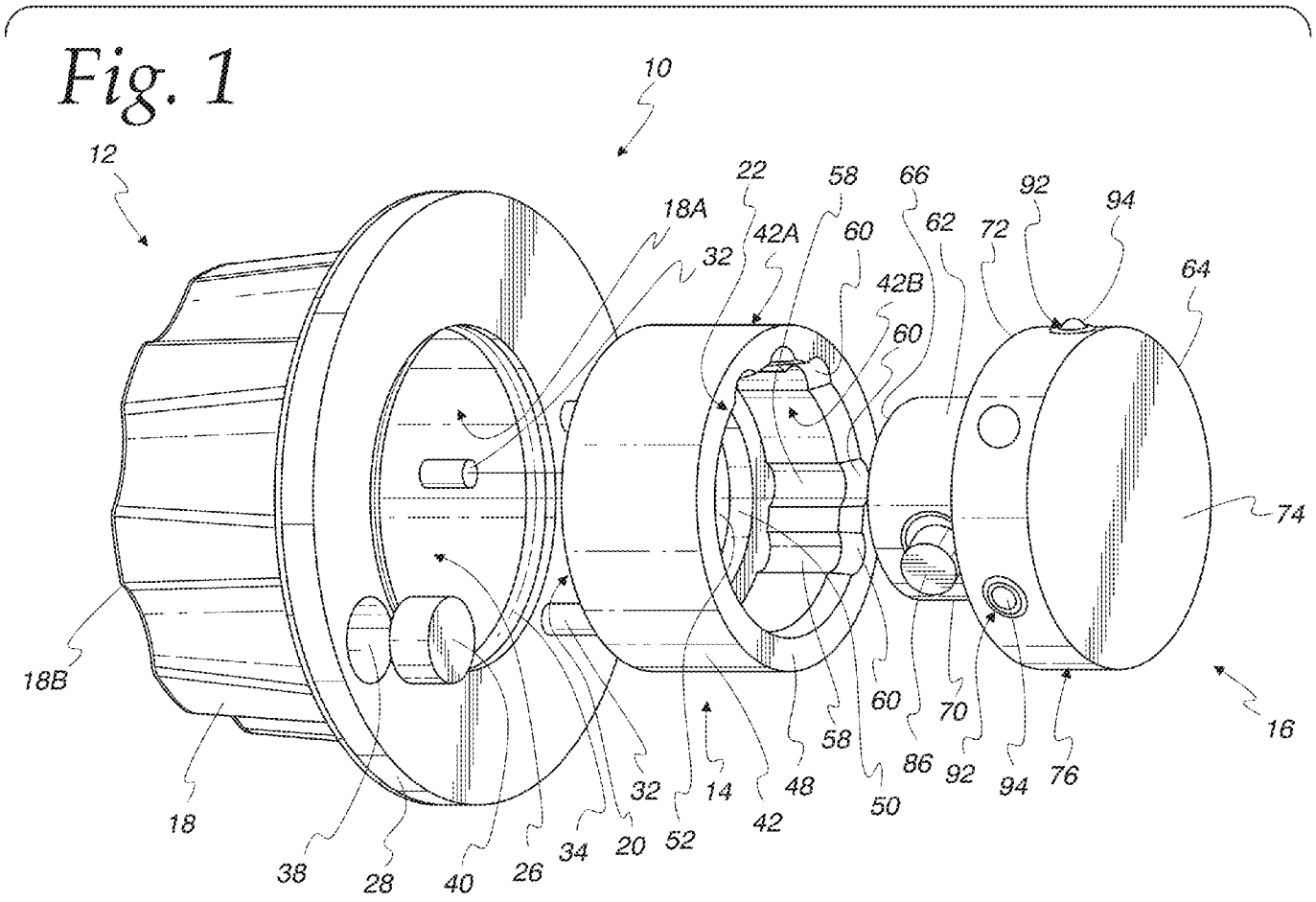
FIG. 1 is an exploded perspective view of a first exemplary embodiment of a modular knob system 10 including a knob shell 12, a haptic ring 14, and a hub 16.
Figure 2:
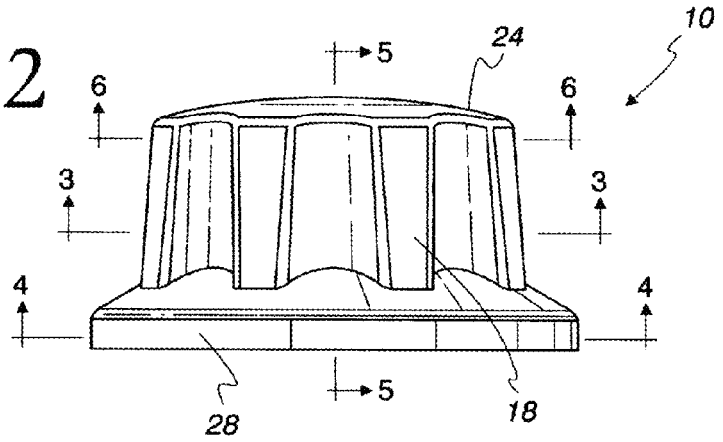
FIG. 2 is a side elevation view of modular knob system 10.
Figure 3:
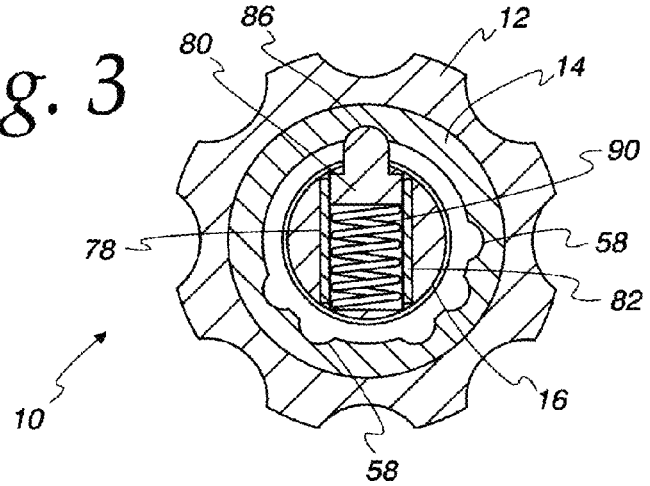
FIG. 3 is a rear sectional view of modular knob system 10 through section 3-3.
Figure 4:
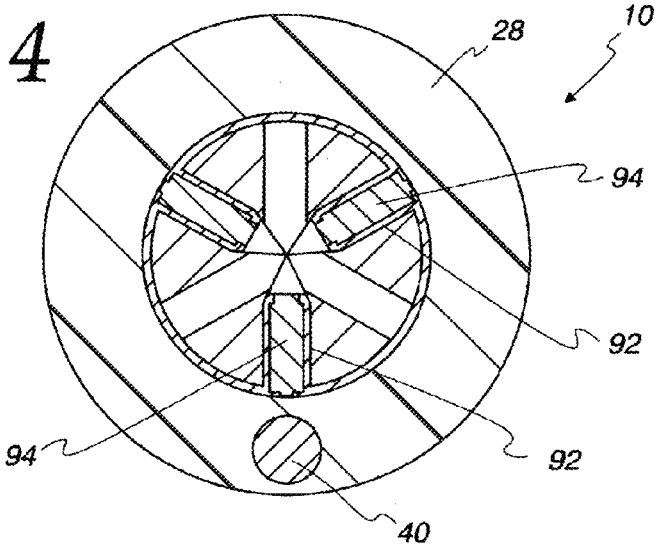
FIG. 4 is a rear sectional view of modular knob system 10 through section 4-4.

The drawings illustrate various embodiments of modular knob systems adapted to provide haptic feedback and capable of activating touch sensors disposed on substrates in connection with which the modular knob systems might be used.

1. First Exemplary Embodiment

FIGS. 1-6 illustrate a first exemplary embodiment of a modular knob system 10. System 10 includes a knob shell 12, a haptic ring 14 and a hub 16 in operable association with each other, as will be described further below.

Knob shell 12 includes a generally annular portion (or sidewall) 18 having an interior surface 18A, an exterior surface 18B, a first (or front) end 20 and a second (or rear) end 22. A cap portion 24 covers first end 20 of sidewall 18, thereby forming a cavity 26 within knob shell 12. A flange 28 extends radially outwardly from second end 22 of sidewall 18 opposite cap 24. The exterior surface of knob shell 12 may be smooth, knurled, fluted, contoured or otherwise configured.

Figure 5:
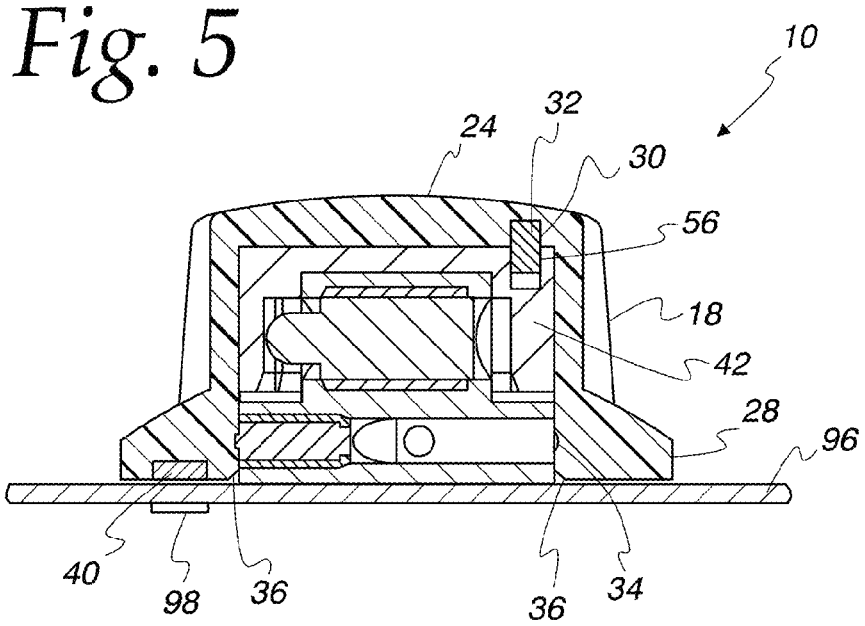
FIG. 5 is a side sectional view of modular knob system 10 through section 5-5.
Figure 6:
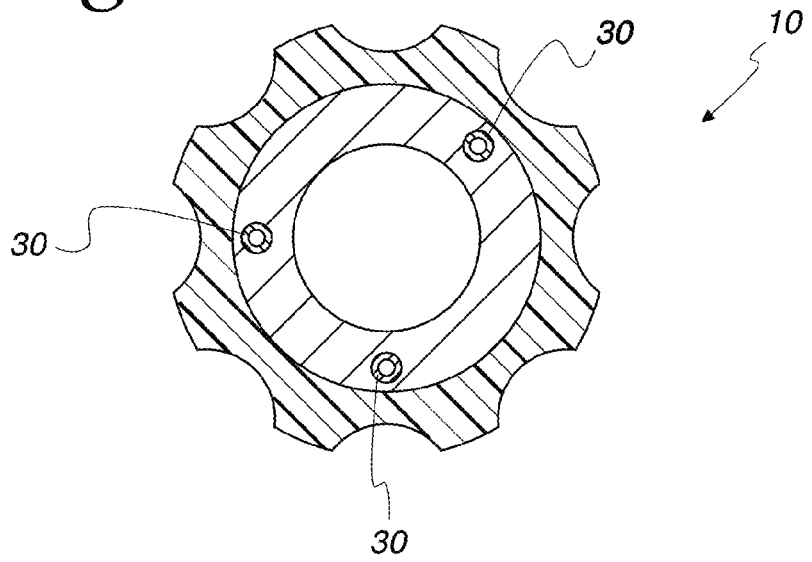
FIG. 6 is a rear sectional view of modular knob system 10 through section 6-6.

As best seen in FIGS. 5 and 6, cap 24 defines one or more (three are shown in FIG. 6) holes 30 extending axially outwardly into cap 24 from cavity 26. Holes 30 preferably are blind. Holes 30 are configured to receive pins 32 as will be discussed further below.

A bearing race 34 is formed in interior surface 18A of sidewall 18 near and axially recessed from second end 22 thereof. Bearing race 34 preferably extends about the entirety of the interior circumference of sidewall 18. Bearing race 34 is configured to receive in bearing engagement the engagement members of one or more ball plungers, as will be discussed further below. A chamfer 36 may be formed at open end 22 of sidewall 18 to facilitate receipt of the ball plunger(s). Chamfer 36, when provided, preferably extends about the entirety of the interior circumference of sidewall 18.

Optionally, flange 28 defines a hole 38 adapted to receive an actuator disc 40 made of a conductive material, as will be discussed further below. Where provided, hole 38 preferably would be blind, and it preferably would extend inwardly from the rear side of flange 28 (that is, the side of flange 28 corresponding to the open end of knob shell 12). In some embodiments, knob shell 12 could include more than one hole 38 and actuator disc 40. In such embodiments, the plural holes 38 and actuator discs 40 could be spaced regularly or irregularly about the circumference of flange 28 and/or at the same or different radial distances from the axis of rotation of knob shell 12. In embodiments including actuator disc(s) 40, flange 28 preferably is made of a non-conductive material, for example, rubber or plastic. The rest of knob shell 12 could be made of any suitable material, including conductive or non-conductive material. In other embodiments, knob shell 12 or any portion thereof could be made of any suitable material, including conductive or non-conductive material.

Haptic ring 14 includes a generally annular portion (or sidewall) 42 having an exterior surface 42A, an interior surface 42B, a first (or front) end 46 and a second (or rear) end 48. In an illustrative embodiment, exterior surface 42A of haptic ring 14 generally conforms to the interior surface 18A of sidewall 18 of knob shell 12. First end 46 of sidewall 14 is partially closed with a washer-like end portion 50 having an aperture 52 therein. Washer-like end portion 50 defines a bearing surface 54 about the periphery of aperture 52 as will be discussed further below. Second end 48 of haptic ring 14 is generally open.

One or more holes 56 are formed into first end 46 of sidewall 42 or an adjacent surface of washer-like portion 50 of haptic ring 14. Holes 56 are configured to receive pins 32 as will be discussed further below. As such, the number of holes 56 in haptic ring 14 preferably equals the number of holes 30 in knob shell 12, and the placement of holes 56 in haptic ring 14 preferably corresponds to the placement of holes 30 in knob shell 12.

Interior surface 42B of haptic ring 14 defines a contour comprising one or more detents 58. Each detent is illustrated as extending between washer-like portion 50 and second end 48. In other embodiments, detents 58 could have a lesser extent. That is, detents 58 need not extend entirely from washer-like portion 50 to second end 48, as will become evident to one skilled in the art. Preferably, detents 58 terminate in a beveled portion 60 at second end 48 of haptic ring 14 to facilitate assembly of knob system 10, as will be discussed further below. Each of detents 58 can, but need not, have identical contours. Further, detents 58 can, but need not, be even spaced about interior surface 44 of haptic ring 14.

Hub 16 includes a generally cylindrical post portion 62 and a generally disc-shaped hat portion 64. Post portion 62 includes a first end 66, a second end 68 and a peripheral surface 70. Hat portion 64 includes a first (or front) side 72, a second (or rear) side 74 and a peripheral surface 76. First end 66 of post portion 62 is attached to first side 72 of hat portion 64 such that post portion 62 and hat portion 64 are generally coaxial.

Post portion 62 defines a hole 78 extending inwardly from peripheral surface 70. Hole 78 can be blind or it can extend through the entire diameter of post portion 62. A ball plunger 80 is disposed in hole 78. As would be understood by one skilled in the art, ball plunger 80 includes a generally annular housing 82, an engagement member 86 in the form of a ball bearing or dome-headed structure extending from an end of housing 82, and a spring 90 or other biasing means configured to bias engagement member 86 outwardly with respect to housing 82. Hole 78 and the outer surface of housing 82 of ball plunger 80 may be threaded to facilitate installation of ball plunger 80 to hub 16 and adjustment of the relative positions thereof. Optionally, post portion 62 may be provided with one or more additional holes 78 and ball plungers 80.

Similarly, one or more holes 92 (a preferred embodiment includes three) are formed into peripheral surface 76 of hat portion 64. Holes 92 may be through holes or blind holes. A ball plunger 94 is disposed in each of holes 92. Ball plungers 94 are similar to ball plunger 80, but may differ in terms of size and spring rate. For example, ball plungers 94 may have larger or smaller engagement members than ball plunger 80. Also, the springs of ball plungers 94 may have higher or lower rates than the rate of spring 90 of ball plunger 80. Holes 92 and the outer surface of the housings of ball plungers 94 may be threaded to facilitate assembly and adjustment thereof, as discussed above with respect to hole 78 and ball plunger 80.

Knob shell 12, haptic ring 14 and hub 16 may be assembled as follows. Pins 32 may be inserted into holes 30 in knob shell 12 or holes 56 in haptic ring 14. Haptic ring 14 may be inserted into cavity 26 of knob shell 12 such that an end portion of each of pins 32 is or becomes disposed in a corresponding hole 30 in knob shell 12 and another end portion of each of pins 32 is or becomes disposed in a respective corresponding hole 56 in haptic ring 14. Pins 32 thereby serve to key haptic ring 14 to knob shell 12. Alternatively, mating key features may be molded or otherwise formed into knob shell 12 and haptic ring 14 to eliminate the need for discrete pins.

First end 46 of haptic ring 14 may, but need not, bear against cap 26 when assembled thereto. The length of haptic ring 14 between first end 46 and second end 48 thereof is such that haptic ring 14 may be disposed between cap 24 of knob shell 12 and bearing race 32 of knob shell 12. Preferably, haptic ring 14 is fixed or removably fastened to knob shell 12 using screwed, staked (thermal or otherwise), adhesive or other techniques as would be known to one skilled in the art.

Hub 16 may be inserted into haptic ring 14 and knob shell 12 such that first end 66 of post portion 62 of hub 16 is disposed within aperture 52 of washer-like end portion 50 of haptic ring 14 and, preferably, in bearing engagement therewith. So assembled, engagement member 86 of ball plunger 80 disposed in post portion 62 of hub 16 engages with the contoured interior surface 42B of haptic ring 14. Also, the engagement members of ball plungers 94 disposed in hat portion 64 of hub 16 engage with bearing race 34 of knob shell 12, thereby releasably securing hub 16 and haptic ring 14 to knob shell 12. So installed, the surface defining first side 72 of hat portion 64 may, but need not, be in bearing engagement with the surface defining second end 48 of haptic ring 14. In any event, knob shell 12, haptic ring 14, pins 32, holes 30, holes 56 and hub 16 are sized such that haptic ring 14 remains keyed to knob shell 12 once assembled as described above.

In operation, a user may grasp the exterior surface 18B of knob shell 12 and apply a torque to knob shell 12. The interaction of the engagement members of ball plungers 94 with bearing race 34 allow rotation of knob shell 12 about hub 16 in response to such torque, while securely holding knob shell to hub 16. As knob shell 12 rotates, haptic ring 16 rotates with it because the two are keyed together by pins 32. As knob shell 12 and haptic ring 16 rotate, engagement member 86 of ball plunger 80 interacts with contoured interior surface 42B and detents 58 of haptic ring 14, thereby providing haptic effect to the user. More particularly, as haptic ring 14 rotates, engagement member 86 is alternately displaced inwardly by a biasing force applied by contoured surface 42B and displaced outwardly by the biasing force provided by spring 90 as engagement member 86 is moved along contoured surface 42B between neighboring detents 58, as would be understood by one skilled in the art.

The detent locations and haptic feel of knob system 10 can be changed by simply removing knob shell 12 from hub 16 (for example, by pulling knob shell 12 axially away from hub 16 with sufficient force to bias the engagement members of ball plungers 94 inwardly a sufficient distance to enable removal of knob shell 12 from hub 16), removing haptic ring 14 which is keyed to knob shell 12 via pins 32, replacing haptic ring 14 with another haptic ring having a different inner surface 44 contour/detent 58 configuration and then reassembling the system as set forth above.

Knob system 10 could be used as an element of a switching or sensing mechanism. In an exemplary embodiment as shown in FIG. 5, hub 16 could be adhered or otherwise attached to a surface of a substrate 96. Alternatively, hub 16 could be integrally formed as a portion of substrate 96. A solid state sensor 98 could be disposed on the same or another surface of substrate 96 and located such that actuator disc 40 could be rotated into and out of proximity with sensor 98. In FIG. 5, touch sensor 98 is shown as being disposed on the rear surface of substrate 96, opposite hub 16.

Sensor 98 could be embodied as a field effect sensor marketed by TouchSensor Technologies, LLC of Wheaton, Ill., assignee of this application and the subject matter described therein. The operating principles of such field effect sensors are described in U.S. Pat. Nos. 5,594,222, 6,310,611 and 6,320,282, the disclosures of which are incorporated herein by reference. In other embodiments, sensor 98 could be embodied as a capacitive sensor or other type of solid state sensor adapted to sense proximity of a stimulus, for example, actuator disc 40. In further embodiments, sensor 98 could be embodied as a magnetic sensor.

Sensor 98 could be positioned at a location corresponding to a position to which actuator disc 40 may be biased by the interaction of ball plunger 86 with detent(s) 58. The sensor could be placed in an actuated state when actuator disc 40 is positioned sufficiently proximate the sensor and in an unactuated state when actuator disc 40 is positioned sufficiently distant from the sensor, as would be understood by one skilled in the art. As such, knob 10 could form part of a solid state switching mechanism emulating the feel of a traditional electromechanical rotary switch.

Other embodiments could include plural sensors 98. In such embodiments, the plural sensors 98 could be positioned at various locations corresponding to the various positions locations to which actuator disc 40 may be biased by the interaction of ball plunger 86 with detents 58. Each sensor could be placed in an actuated state when actuator disc 40 is positioned sufficiently proximate the sensor and in an unactuated state when actuator disc 40 is positioned sufficiently distant from the sensor, as would be understood by one skilled in the art. As such, knob 10 could form part of a multifunction solid state switching mechanism emulating the feel of a traditional electromechanical rotary switch.

In some embodiments, plural sensors 98 could be disposed at regular or irregular intervals proximate the arc through which actuator disc 40 travels (or arcs through which plural actuator discs 40 travel) as knob 12 is turned. In such embodiments, the detent mechanism of knob system 10 could be configured to bias actuator disc 40 towards positions proximate only a certain one or more of such plural sensors 98 at one or more corresponding predetermined angular positions of knob shell 12, as would be understood by one skilled in the art. In such embodiments, it might be desirable for only the certain one or certain ones of the plural sensors 98 to be actuated in response to the proximity of actuator disc 40 and for any additional sensors 98 to be deactivated. The deactivation could be accomplished through hardware or software means, as would be understood by one skilled in the art. Different sets of sensors 98 could be activated and deactivated to support use of a different haptic ring 14 having a different detent contour, as would be understood by one skilled in the art. As such, a substrate 96 having a single "universal" sensor structure thereon could be used to support a variety of different applications and knob detent configurations, as would be understood by one skilled in the art.

2. Second Exemplary Embodiment

Figure 7:
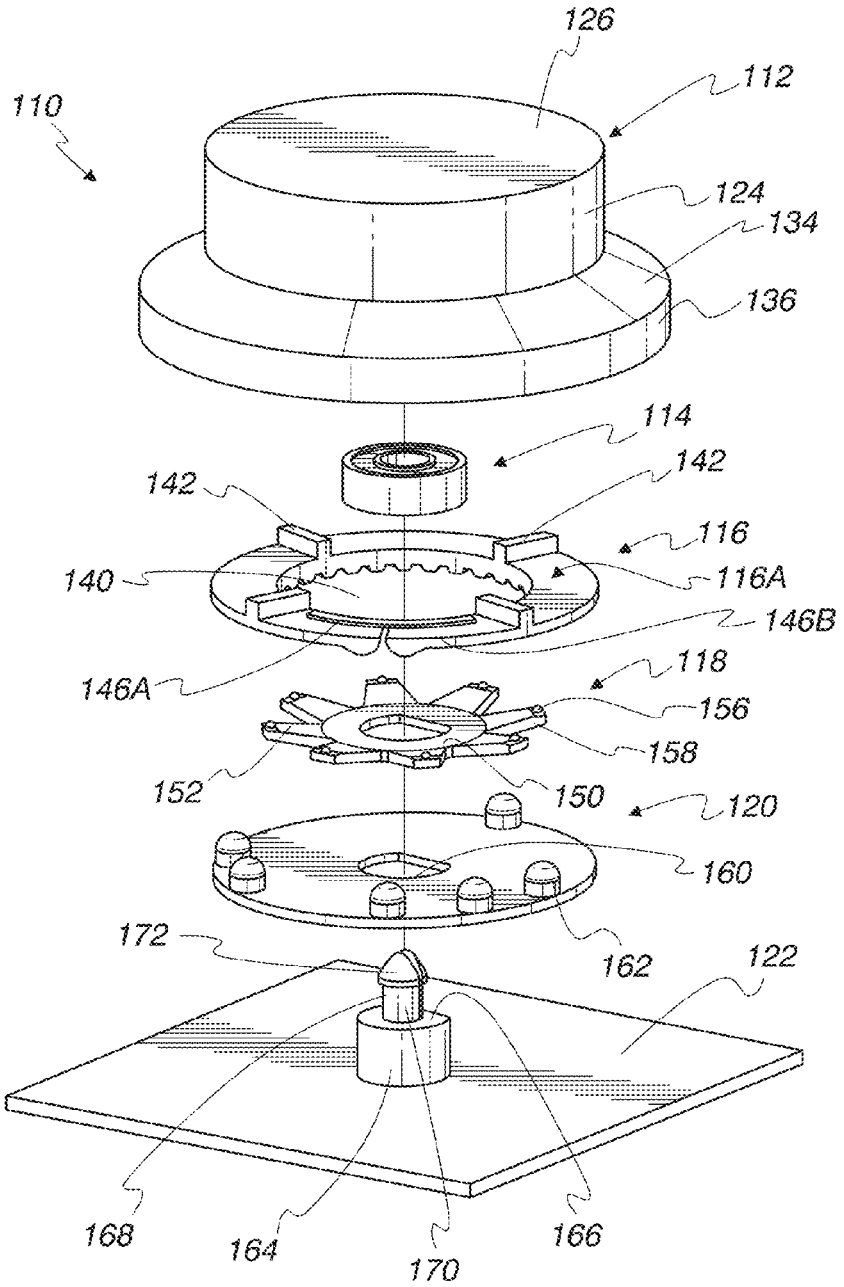
FIG. 7 is a front exploded perspective view of a second exemplary embodiment of a modular knob system 110 including a knob shell 112, a roller bearing 114, a detent ring 116, a detent spring 118, a detent plate 120 and a faceplate 122.
Figure 8:
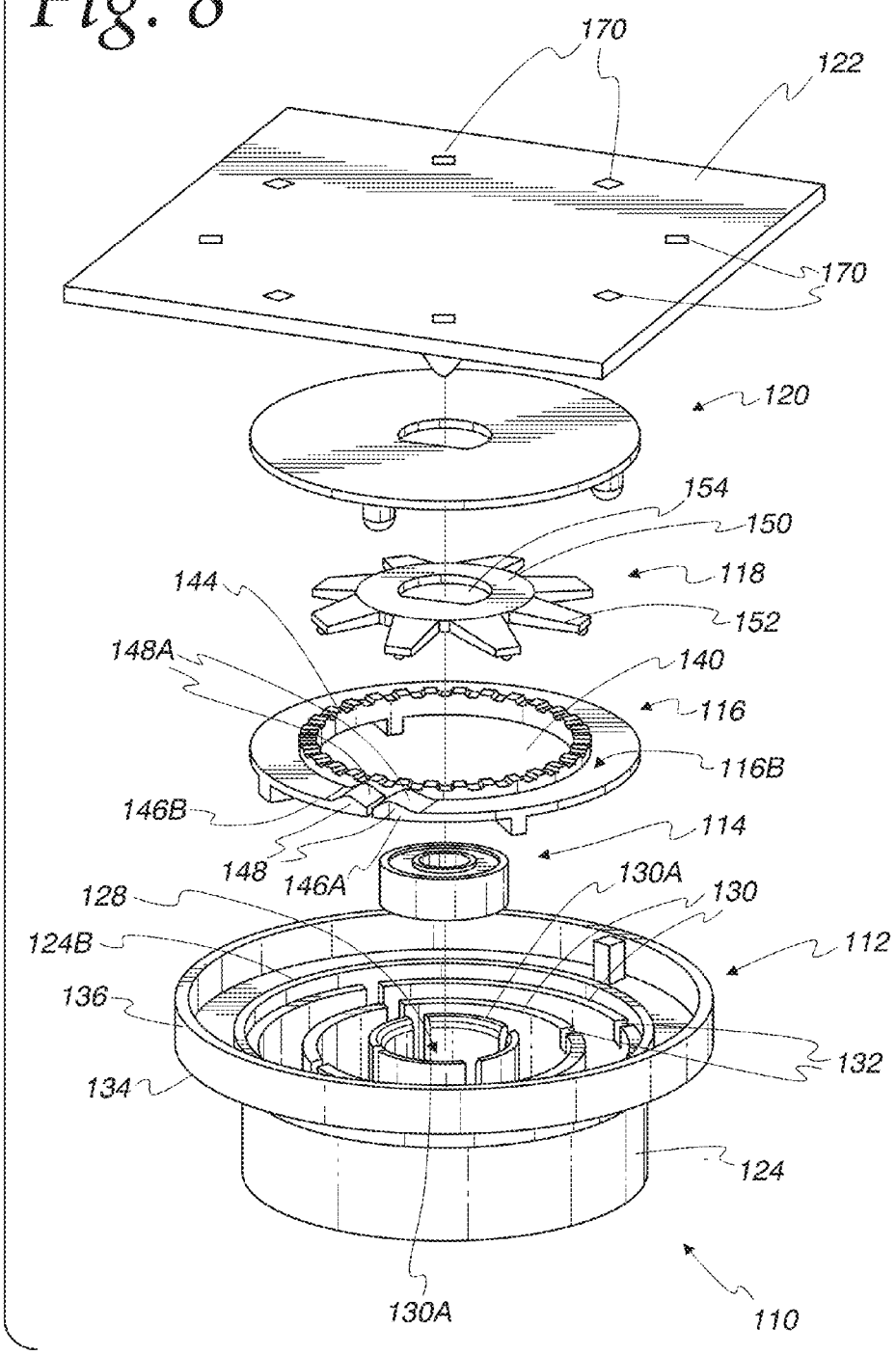
FIG. 8 is a rear exploded perspective view of modular knob system 110.
Figure 9:
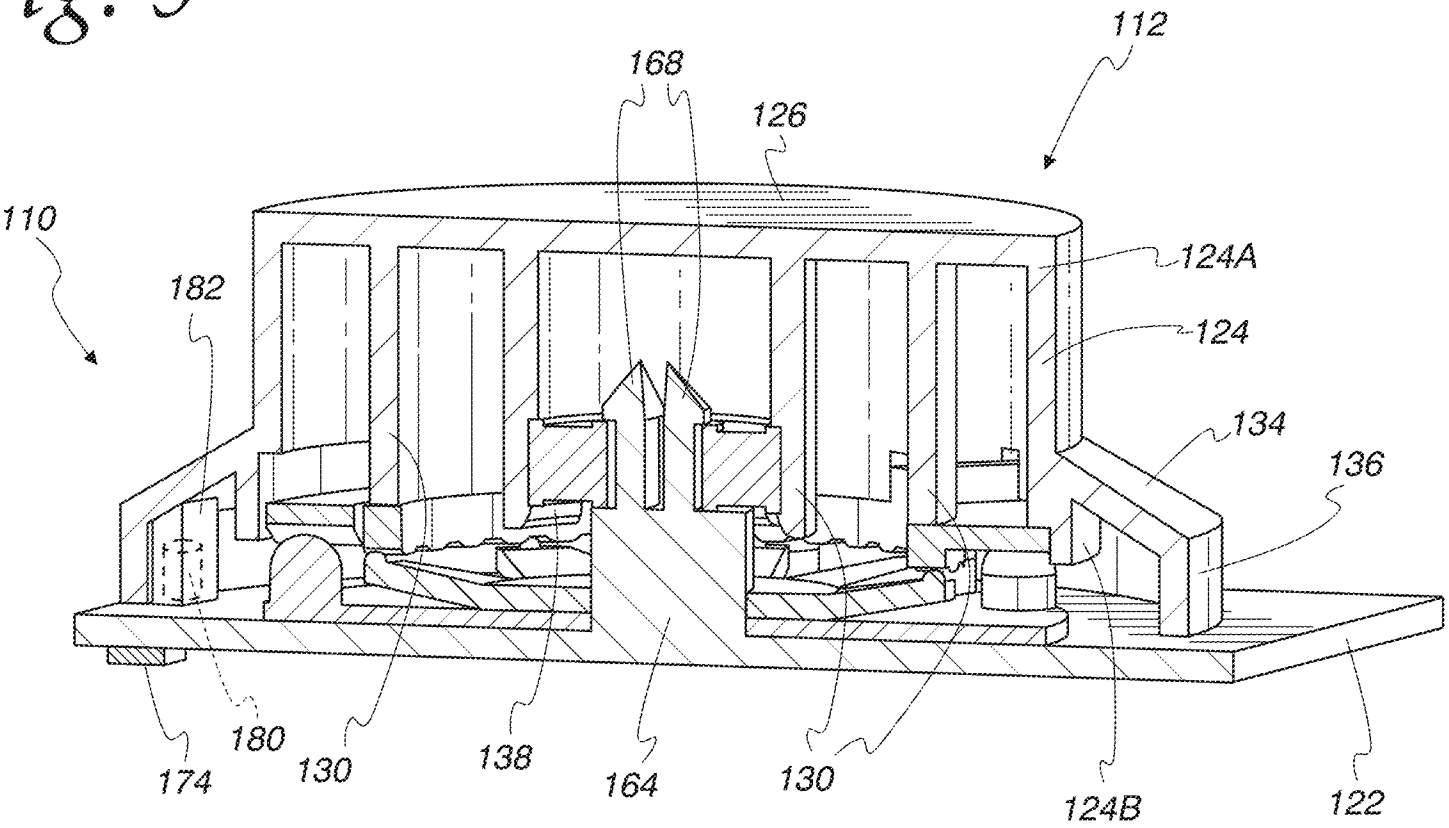
FIG. 9 is a cross-sectional side elevation view of modular knob system 110.
Figure 10:
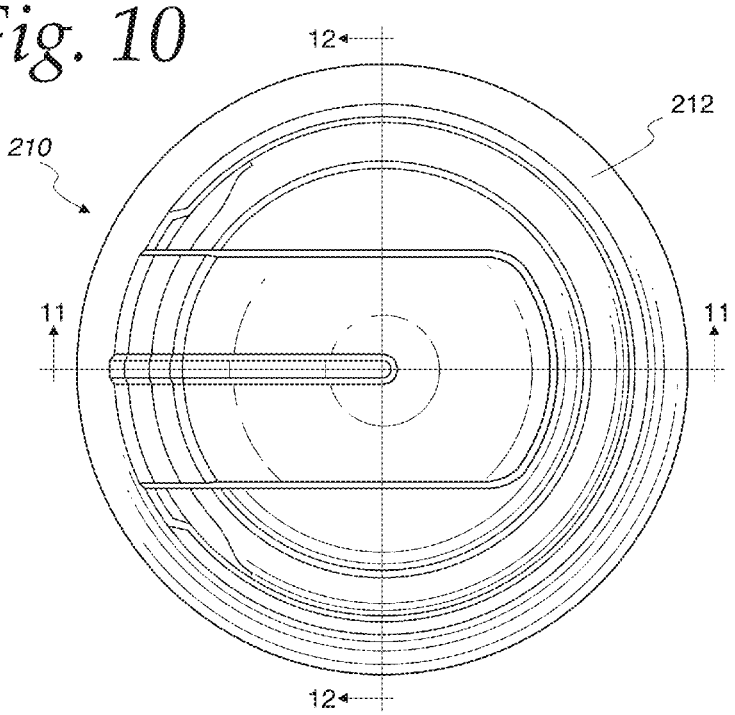
FIG. 10 is a top plan view of a third exemplary embodiment of a modular knob system 210.
Figure 11:
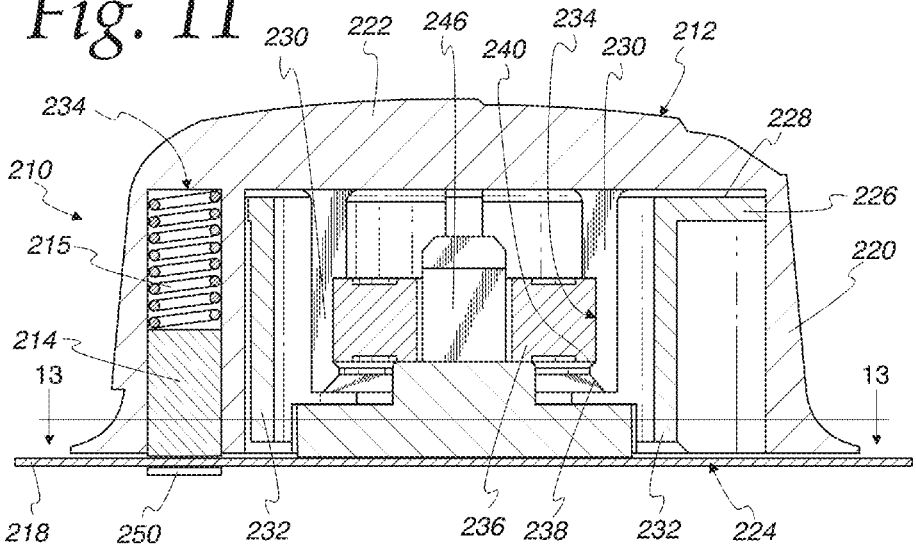
FIG. 11 is a side sectional view of modular knob system 210 through section 11-11.
Figure 12:
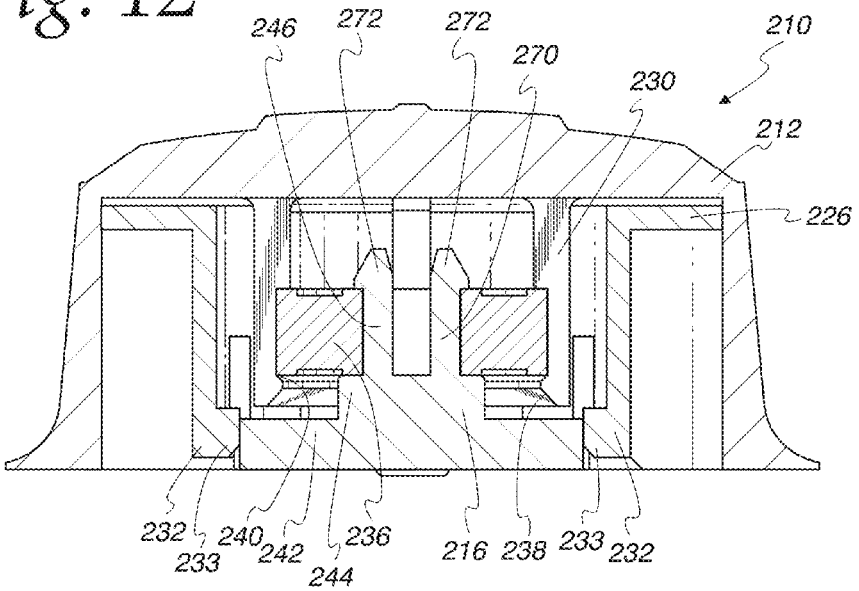
FIG. 12 is a side sectional view of modular knob system 210 through section 12-12.
Figure 13:
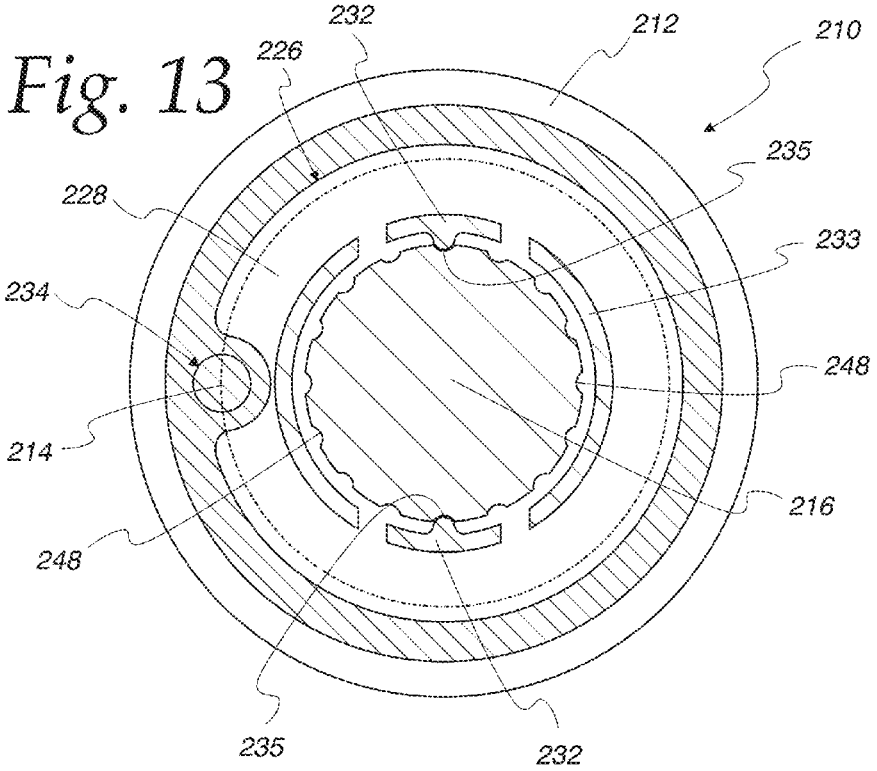
FIG. 13 is a top sectional view of modular knob system 210 through section 13-13.
Figure 14:
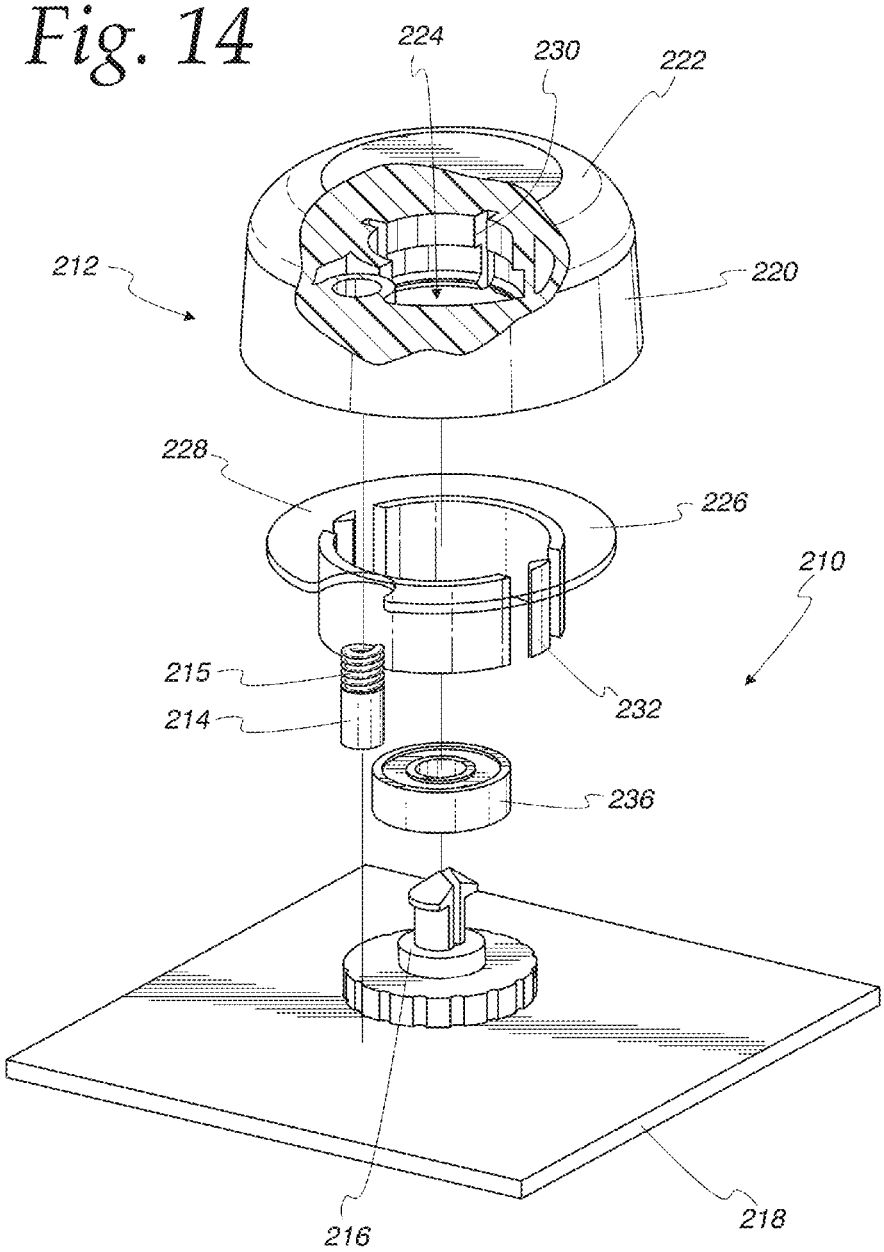
FIG. 14 is an exploded perspective view of modular knob system 210.

FIGS. 7-9 illustrate a second exemplary embodiment of a modular knob system 110. Knob system 110 includes a knob shell 112, a roller bearing 114, a detent ring 116, a detent spring 118, a detent post plate 120 and a faceplate 122 in operable association with each other, as will be described further below.

Knob shell 112 includes a generally annular sidewall 124 having a first (or front) end 124A and a second (or rear) end 124B. A cap 126 is joined to first end 124A of sidewall 124, thereby closing first end 124A of sidewall 124 and forming a cavity 128 within knob shell 112. A plurality of annular rings 130 extend from the surface of cap 126 located within cavity 128 toward open second end 124B of sidewall 124. Rings 130 generally are concentric with each other and with side wall 124. One or more of rings 130 may include slots 132 extending from the free ends thereof to or toward cap 126, as shown in FIG. 8, and as will be discussed further below. In embodiments wherein more than one ring 130 includes slots 132, corresponding slots 132 of the several rings 130 may be radially aligned. A flange 134 extends generally radially outwardly from second end 124B of sidewall 124. Flange 134 can extend from sidewall 124 in a manner perpendicular to the longitudinal axis of sidewall 124, or, as shown in the drawings, at another angle to the longitudinal axis of sidewall 124. A further annular ring (or "skirt") 136 extends axially from an outer portion of flange 134 end 124B of sidewall 124 in a rearward direction.

The innermost annular ring 130A of knob shell 112 is configured to receive roller bearing 114, as will be discussed further below. Innermost annular ring 130A includes a lip 138 extending inwardly from the inner sidewall thereof, proximate the free end thereof. Lip 138 includes a first surface 138A facing the exterior of cavity 128 and a second surface 138B facing the interior of cavity 128. First surface 138A preferably is chamfered to facilitate installation of roller bearing 140, as will be discussed further below. Second surface 138B preferably extends from the inner sidewall of ring 130A at a right angle or another angle selected such that roller bearing 114 cannot be easily, inadvertently removed from ring 130A once inserted therein.

Roller bearing 114 can be embodied as a conventional roller bearing as would be recognized by one skilled in the art. Roller bearing 114 includes an outer peripheral surface and an inner peripheral surface. Preferably, the outer peripheral surface of roller bearing 114 and the inner surface of innermost annular ring 130A are configured so that roller bearing 114 fits snugly within innermost annular ring 130A. In some embodiments, roller bearing 114 may fit sufficiently snugly within innermost annular ring 130A such that lip 138 is not required for retention of roller bearing 114. In such embodiments, lip 138 could be omitted.

Detent ring 116 is a generally washer-shaped or ring-shaped member defining a center opening 140 therein. Detent ring 116 has a first (or front) surface 116A and a lower (or rear) surface 116B. Front surface 116A is generally flat with one or more (four are shown) tabs 142 projecting forwardly therefrom. Tabs 142 can, but need not extend across the width of detent ring 116 from its outer perimeter to the inner circumference defined by opening 140. A portion of rear surface 116B of detent ring 116 defines a contoured detent portion 144. Detent portion 144 is illustrated as being adjacent the inner circumference of detent ring 116. In alternate embodiments, detent portion 144 could by located adjacent the outer perimeter of detent ring 116 or anywhere in between the inner circumference and outer perimeter of detent ring 116. Individual detents of detent portion 144 preferably, but not necessarily, are evenly spaced from each other and have similar overall geometry. So configured, detent portion 144 can provide for a uniform haptic effect when modular knob system is operated as discussed further below.

A portion of detent ring 116 is circumferentially and radially severed from the balance of detent ring 116 so as to form two spring elements 146A and 146B. Detent ring 116 is made of a material, for example a plastic or metallic material, that allows spring elements 146A, 146B to flex resiliently with respect to the balance of detent ring 116. More particularly, spring elements 146A, 146B can flex with respect to detent ring 116 in response to a biasing force and resiliently return toward their original position upon release of the biasing force. Each of spring elements 146A, 146B terminates in a bump 148 having ramps 148A on both sides thereof. Bumps 148 are disposed, on and face axially away from, rear surface 116B of detent ring 116.

Detent spring 118 is a generally star-shaped member having a center or hub portion 150 and a plurality (eight are shown but more or fewer could be used) of spoke portions 152 extending radially outwardly and canted axially from hub portion 150. Hub portion 150 includes a D-shaped center opening 154 to enable keying of detent spring 118 to retainer post 164, as discussed further below. Spoke portions 152 are illustrated as being symmetrically arranged about hub portion 150, but they need not be. Spoke portions 152 extend generally radially from hub portion 150, but at an angle thereto such that spoke portions 152 are not coplanar with hub portion 150. A bump 156 is located near the tip of each of spoke portions 152 extending axially from a forward-facing surface thereof. Spokes 152 can terminate in beveled surfaces 158 such that beveled surfaces 158 are generally parallel to hub portion 150 or at least more so than are spoke portions 152 generally. Spoke portions 152 are flexibly resilient so that they can be flexed toward a position generally planar with hub portion 150 in response to a biasing force applied to spoke portions 152 and then return toward their original position when the biasing force is released. Spoke portions 152 and bumps 156 are sized to facilitate engagement of bumps 156 with detent contour 144 of detent ring 116.

Detent post plate 120 is a generally planar and circular member. Detent post plate 120 defines a D-shaped center opening 160 to enable keying of detent post plate 120 to retainer post 164, as discussed below. One or more detent posts 162 extend axially away from a forward-facing surface of detent post plate 120. The free ends of detent posts 162 preferably are hemispherical or otherwise define a smooth continuous domed or otherwise shaped surface for ease of engagement with spring elements 146A, 146B of detent ring 116, as will be discussed further below. Detent posts 162 could be regularly or irregularly spaced from each other. Irregular spacing is shown in, for example, FIG. 7.

Face plate 122 is a substrate having a retainer post 164 extending outwardly from a forward-facing surface thereof. Post 164 includes a base portion 166 configured for engagement with opening 154 in detent spring 118 and opening 160 in detent post plate 120. (Base portion 166 is shown as D-shaped to complement the D-shaped openings in detent spring 118 and detent post plate 120. In other embodiments, base portion 166, opening 154 in detent spring 118 and opening 160 in detent post plate 120 could have other complementary shapes to enable keying of the components with one another, as would be understood by one skilled in the art.) A bearing retainer 168 extends upwardly from base portion 166 of retainer post 164.

Bearing retainer 168 is illustrated as a snap fit structure having a cylindrical base portion 170 and a mushroom shaped head portion 172. Base portion 170 and head portion 172 of bearing retainer 168 are split longitudinally to enable limited flexible and resilient lateral movement of the two resulting halves to allow assembly of roller bearing 114 thereto, as will be discussed further below.

Knob shell 112, roller bearing 114, detent ring 116, detent spring 118, detent post plate 120 and face plate 122 may be assembled as follows. Detent post plate 120 is installed onto retainer post 164 so that these two elements are keyed together by means of their corresponding D-shaped sections. Detent post plate 120 can be positioned so that a lower surface thereof is in contact with and substantially flush with an upper surface of faceplate 122, and such that detent posts 162 face away from faceplate 122. Detent spring 118 is installed atop detent post plate 120 in a similar manner, with bumps 156 facing away from faceplate 122 and detent post plate 120. Roller bearing 114 is pressed into the space defined by innermost annular ring 130A of knob shell 112 so that roller bearing 114 is retained by lip 138, as discussed further above. (Slots 132 may be provided in annular ring 130A to facilitate assembly of roller bearing 114 to knob shell 112, as would be understood by one skilled in the art. Detent ring 116 is installed to knob shell 112 so that tabs 142 of detent ring 116 engage with corresponding slots 132 of annular ring(s) 130 of knob shell 112, thereby keying detent ring 116 to knob shell 112. Roller bearing 114 is installed to bearing retainer 168 of retainer post 164 and is engaged therewith by means of head portion 172. As roller bearing 114 is pressed onto bearing retainer 168, the inside diameter of roller bearing 114 contacts the sides of head portion 172 and applies thereto a lateral force that biases the sides of head portion 172 toward each other. Once roller bearing 114 has been pressed past head portion 172, the biasing force is sufficiently released such that the sides of head portion 172 return toward their original positions, thereby securing roller bearing 114 to bearing retainer 168, as would be understood by one skilled in the art. Alternatively, roller bearing 114 could be attached to bearing retainer 168 as set forth above and knob shell 112 could then be pressed onto roller bearing 114.

In operation, a user rotates knob shell 112 with respect to face plate 122. Detent ring 116 is keyed to knob shell 112 by tabs 142 and slots 132 so that detent ring 116 rotates with knob shell 112. Detent spring 118 and detent post plate 120 are keyed to faceplate so that knob shell 112 and detent ring 116 rotate with respect to these elements. As detent ring 116 rotates, detents 144 on lower surface 116B of detent ring 116 interact with bumps 156 on spokes 152 of detent spring 118. More particularly, detents 144 apply an alternately increasing and decreasing biasing force to bumps 156 and spokes 152. Spokes 152 alternately deflect and then return toward their original position as the biasing force is applied and released in response to rotation of detent ring 116. This provides a first form of haptic feedback. Typically, but not necessarily, detent contour 144 would be relatively shallow, and the haptic feedback provided thereby would be "minor."

Also, as detent ring 116 rotates, bumps 148 at ends of spring elements 146 ride over detent posts 162 on detent post plate 120. The pair of spring elements 146 taken together form a resting area or detent contour in which detent posts 162 can rest. When detent ring 116 is rotated, detent posts 162 impart a biasing force against spring elements 146 causing spring elements 146 to resiliently flex away from and return to their original position as detent ring 116 is rotated relative to detent post plate 120.

The haptic feel and detent locations can be changed by simply removing knob shell from retainer post 164 (for example, by pulling knob shell 112 axially away from retainer post 164) (a tool may be required to enable disassembly), and replacing one or more of detent ring 116, detent spring 118 and detent post plate 120 with a similar component having different arrangements of detents and/or detent springs. For example, a particular detent ring 116 could be replaced with a similar detent ring 116 having a different detent contour affording different haptic feel. The detent contour could differ in terms of the spacing between detents, the relative depth of the detents, and/or other manners. Similarly, a particular detent spring 118 could be replaced with another detent spring having other biasing force characteristics. It may be desirable or necessary to match a particular detent spring with a particular detent ring to ensure compatibility, as would be understood by one skilled in the art. Also, a particular detent post plate 120 could be replaced with another detent post plate having different spacing between detent posts and/or detent posts having different sizes and/or shapes.

One or more actuators 180 could be associated with knob shell 112 in a manner similar to that in which actuator disc 40 is associated with knob shell 12 of the first exemplary embodiment. For example, an actuator 180 could be embedded in skirt 136 or an appendage 182 thereof, as shown in FIG. 9. Alternatively, actuator 180 could be provided in association with knob shell 112 or another component keyed thereto in any suitable manner, as would by understood by one skilled in the art.

Also, one or more touch sensors 174 could be associated with faceplate 122 or an adjacent substrate in a manner similar to that in which sensors 98 may be associated with substrate 96 of the first exemplary embodiment. Such sensors 174 could be structurally, operably and functionally equivalent to sensors 98 of the first exemplary embodiment.

Embodiments including one or more actuators 180 and/or sensors 174 could be configured such that at least one actuator 180 is aligned with or proximate at least one sensor 174 when knob system is oriented to at least one major detent location, in a manner similar to that discussed above in connection with the first exemplary embodiment.

3. Third Exemplary Embodiment

FIGS. 10-14 a third exemplary embodiment of a modular knob system 210 including a knob shell 212, a roller bearing 236, a hub 216, and a base plate 218 in operable association with each other, as will be described further below.

Knob shell 212 includes a generally annular portion (or sidewall) 220 and a cap portion 222 covering a first end of annular portion 220. Annular portion 220 and cap 222 cooperate to define a cavity or interior portion 224.

Bearing retainers 230 depend from cap portion 222 of shell 212 and extend toward base plate 218, generally perpendicular thereto. Each bearing retainer 230 defines an outer surface facing sidewall 220 and an inner surface facing away from sidewall 200. The inner surface of each bearing retainer 230 defines a circumferential recessed portion 234. Recessed portion 234 is configured to receive and retain the outer surface of roller bearing 236. The free ends of bearing retainers 230 may define a first bevel 238 to facilitate assembly of roller bearing 236 to bearing retainers 230, as would be understood by one skilled in the art. Bearing retainers 230 may further define a second bevel 240 adjacent recessed portion 234. The second bevel 240 may be configured to securely retain roller bearing 236 during normal operation of knob system 210, yet allow removal of roller bearing 236 from recessed portion 234 in response to a substantial axial force, as would be understood by one skilled in the art. This configuration allows for intentional removal of roller bearing 236 from bearing retainer 230, but inhibits spurious or unintentional removal.

Bearing retainers 230 are sufficiently rigid to retain roller bearing 236 as discussed above, and they may provide some degree of structural rigidity to knob shell 212. At the same time, bearing retainers 230 are sufficiently flexible and resilient to allow roller bearing 236 to assembled thereto and/or disassembled therefrom. The illustrated embodiment includes two generally semi-annular bearing retainers 230. Other embodiments could include two or more bearing retainers 230 of substantially less than semi-annular extent, as would be understood by one skilled in the art.

A detent ring 226 is disposed within cavity 224. Detent ring 226 includes a generally circular or disc-like top portion 228. Detent springs 232 and skirts 233 depend from top portion 228 and extend toward base plate 218, generally perpendicular thereto. Together, detent springs 232 and skirts 233 generally define a portion of an annular ring depending from top portion 228.

Detent ring 226 may be joined to knob shell 212 by means of an interference fit between, for example, top portion 228 of detent ring 226 and the interior portion of sidewall 220 of knob shell 212 where top portion 228 is to be seated. Alternatively, detent ring 226 may be slip fit within knob shell 212 and adhered thereto using an adhesive. For example, top portion 228 of detent ring 226 could be glued to the underside of cap 222. Detent ring 226 may be joined to knob shell 212 in other manners, as well.

Detent springs 232 are flexibly resilient such that they can be flexed outwardly towards sidewall 220 in response to a biasing force applied laterally thereto, and return toward their original positions upon release of the biasing force.

Each detent spring 232 defines an outer surface facing sidewall 220 and an inner surface facing away from sidewall 220. Detent springs 232 have a generally arcuate cross section. A rib 235 is disposed on the inner surface of each detent spring 232 near the free end thereof. Ribs 235 are configured to selectively engage with detents in a detent contour, as will be discussed further below. Alternatively, detent springs 232 could have other forms configured such that a portion thereof could selectively engage with such detents, as would be understood by one skilled in the art. The illustrated embodiment includes two detent springs 232. Other embodiments could include more or fewer detent springs 232.

Bearing retainers 230 are described and illustrated as being integrated with knob shell 212, and detent springs 232 are described and illustrated as being integrated with detent ring 226. In other embodiments, bearing retainers 230 could be integrated with detent ring 226 instead of knob shell 212. Also, detent springs 232 could be integrated with knob shell 212, in which case detent ring 226 could be omitted.

A cylindrical recess 234 is formed within sidewall 220 of knob shell 212. Recess 234 extends from the rear surface of sidewall 212 toward cap 222. Recess 234 is configured to receive a biasing spring 236 and an actuator rod 238 in sliding association with recess 234. Biasing spring 236 is configured to bias actuator rod 238 toward base plate 218, as will be discussed further below. Biasing spring 236 is shown as a helical spring. Alternatively, biasing spring 236 could be embodied as an elastomeric member or other resilient member capable of providing a biasing force to actuator rod 238. Some embodiments could include a plurality of recesses 234, actuator rods 238, and biasing springs 236 disposed at regular or irregular intervals about knob shell 212 and at the same or different radial distances from the longitudinal axis thereof.

Hub 216 includes a base 242, a stand-off 244 extending upwardly from base 242, and a post 246 extending upwardly from stand-off 244. The outer circumferential surface of base 242 defines a detent contour including one or more detents 248. Each detent 248 is configured to receive the corresponding detent engagement structure of detent springs 232, for example, rib 233, as discussed above. In embodiments in which the detent contour includes plural detents 248, the detents may be regularly or irregularly spaced about base 242.

Stand-off 244 is configured to provide clearance between the upper surface of base 242 and the free ends of bearing retainers 230 and detent springs 232. Preferably, at least a minimal gap exists between the upper surface of base 242 and the free ends of bearing retainers 230 and detent springs 232 such that bearing retainers 230 and detent springs 232 do not bear against base 242.

Post 246 is illustrated as a snap fit structure having a cylindrical portion 270 and a mushroom-shaped head portion 272. Cylindrical portion and head portion 172 are split longitudinally to enable limited flexible and resilient lateral movement of the two resulting halves to allow assembly of roller bearing 236 thereto, as will be discussed further below, and as would be understood by one skilled in the art.

Hub 216 is attached to or integrally formed with base plate 218. One or more sensors 250, which may be similar to sensors 170 of the second embodiment discussed above, may be disposed on the opposite surface of base plate 218, either directly or on an intervening circuit carrier (not shown). Each sensor 250 may be electrically connected to another circuit element disposed on base plate 218, the foregoing intervening circuit carrier, or another substrate. Typically, at least an electrical circuit trace would be disposed on the same substrate as a given sensor 250. Some embodiments could include plural sensors 250 arranged and operable in a manner similar to plural sensors 170 as discussed above in connection with the second exemplary embodiment.

Knob system 210 could be assembled as follows. Detent ring 226 could be press fit into or adhesively attached to knob shell 212, as discussed above. Roller bearing 236 could be pressed into bearing retainers 230 and then onto post 246. Alternatively, roller bearing 236 could be pressed onto post 246 and then into bearing retainers 230. If not formed integrally with base plate 218, hub 216 could be attached thereto using adhesives or other suitable means. Spring 236 and actuator rod 238 would be assembled into recess 234 prior to assembly of knob shell 212 to base plate 218.

In operation, a user rotates knob shell 212 with respect to base plate 218. Because insert 226 is fixed to knob shell 212, insert 226 rotates with knob shell 212. Insert 226 further rotates with respect to hub 216. As insert 226 rotates, ribs 235 of detent springs 232 become engaged and disengaged with detents 248 formed into hub 216.

Also, as knob shell 212 rotates, actuator rod 238 moves into and out of proximity with sensor(s) 250, thereby actuating sensor 250.

4. Fourth Exemplary Embodiment

Figure 15:
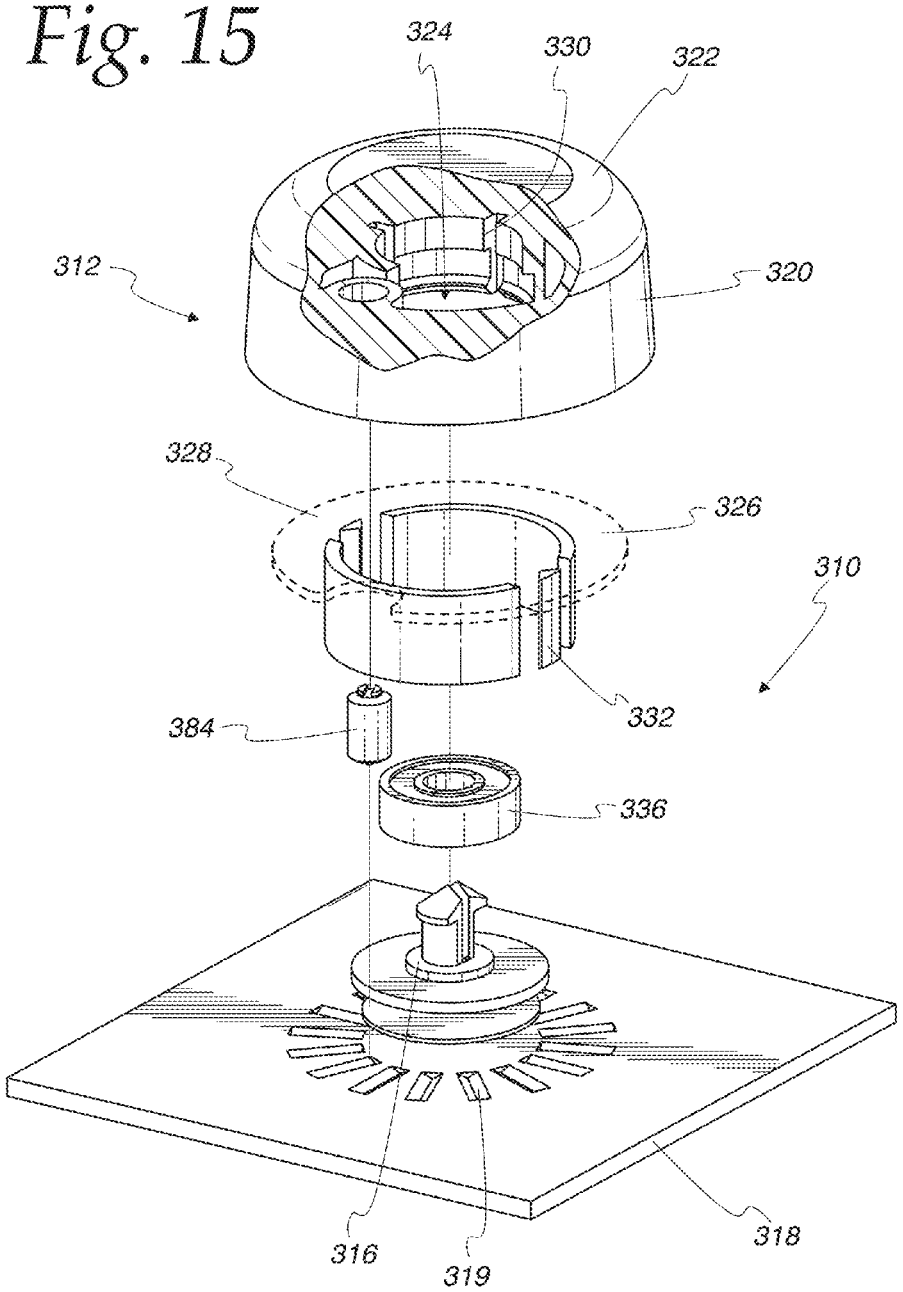
FIG. 15 is an exploded perspective view of a fourth exemplary embodiment of a modular knob system 310.
Figure 16:
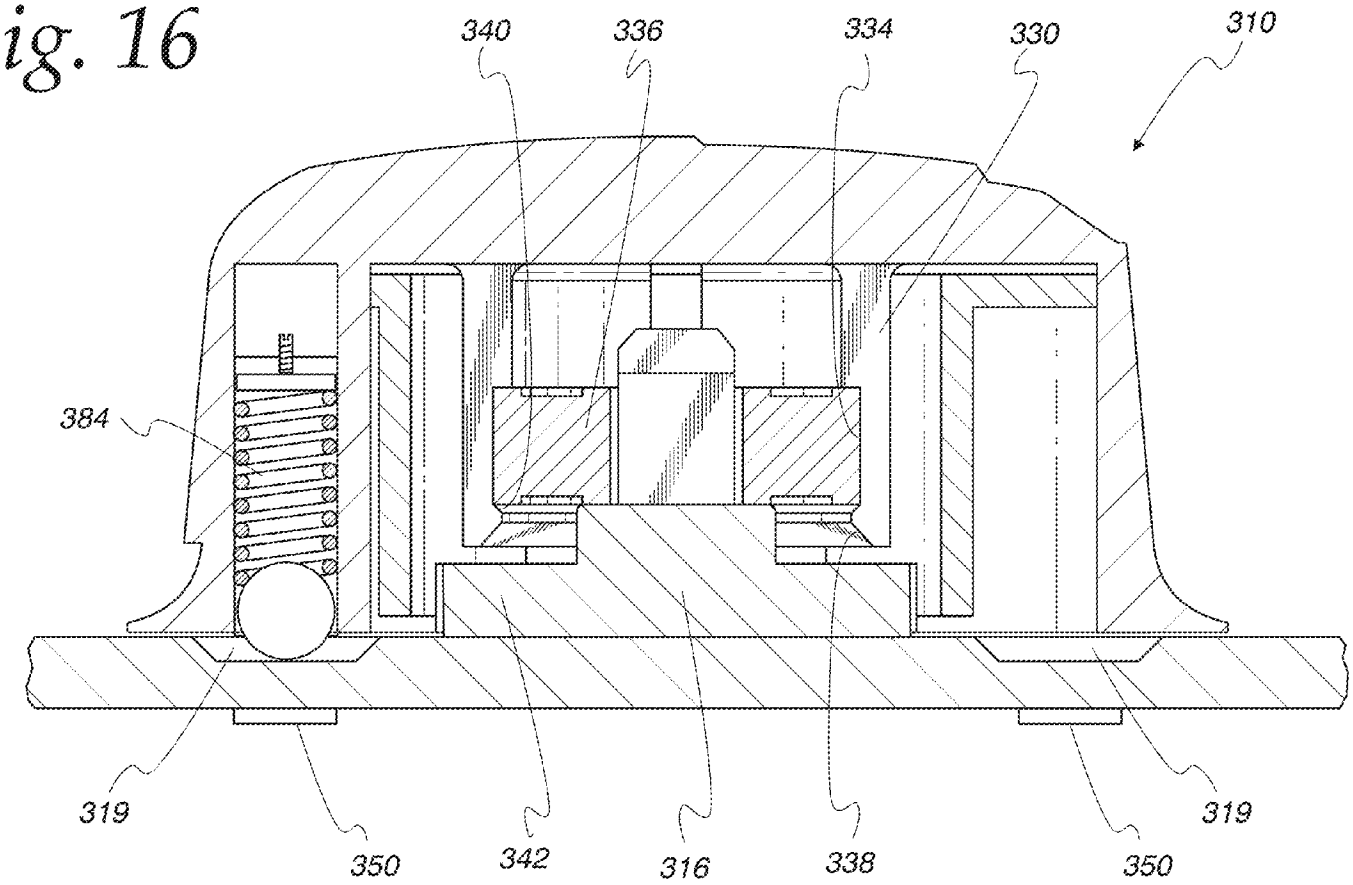
FIG. 16 is a cross-sectional side elevation view of modular knob system 310.

FIGS. 15-16 illustrate a fourth exemplary embodiment of a modular knob system 310. Knob system 310 is identical to knob system 210 in most respects. Knob system 310 differs from knob system 210 in that knob system 310 includes a second detent mechanism.

More particularly, knob shell 312 of knob system 310 defines a cylindrical recess (not shown) similar to cylindrical recess 234 receiving an actuator rod and biasing spring similar to actuator rod 214 and biasing spring 215 of knob system 210.

Knob shell 312 also defines an additional cylindrical recess 334 similar to cylindrical recess 234. Additional cylindrical recess 334 receives a ball plunger 384 similar to the ball plungers discussed in connection with the first exemplary embodiment. Ball plunger 384 is disposed within recess 334 so that the ball bearing or other engagement member of ball plunger 384 extends and is biased outwardly from recess 334 toward base plate 318 so that the engagement member may interact with detent structure associated with base plate 318, as discussed further below.

Ball plunger 384 could be located at the same radial distance from the longitudinal axis of knob shell 312 as the foregoing actuator rod. Alternatively, ball plunger 384 and the actuator rod could be located at a different radial distance from the longitudinal axis of knob shell 312.

Base plate 318 of knob system defines a detent contour including at least one detent structure. In the illustrated embodiment, this detent contour includes a plurality of detent structures in the form of cavities 319 formed into the upper surface of base plate 318. Cavities 319 are generally elongated and have two beveled portions. One side of each beveled portion terminates at upper surface of base plate 318 and the other side of each beveled portion terminates at an adjacent beveled portion. The detent structures could be embodied in other ways, as well. For example, the detent structures could be embodied as pairs of raised surfaces or raised rings configured to receive the engagement member of ball plunger 384.

Cavities 319 are oriented radially about a center point coinciding with the longitudinal axes of hub 316 and knob shell 312. As illustrated, cavities 319 are arranged at regular intervals about the center point. In other embodiments, cavities 319 could be arranged at regular and/or irregular intervals about the center point. In any event, cavities 319 are arranged to selectively receive or otherwise interact with the engagement member of ball plunger 384 when knob shell 312 is rotated, as discussed further below.

Knob shell 312 could include one or more additional recesses 334 and additional ball plungers 384 disposed at the same radial distance from the longitudinal axis of knob shell 312 as the foregoing recess 334 and ball plunger 384. Alternatively, one or more additional recesses 334 and ball plungers 384 could be disposed at one or more different radial distances from the longitudinal axis of knob shell 312 as the foregoing recess 334 and ball plunger 384.

Knob system 310 may include one or more sensors 350 associated with base plate 318. Sensor(s) 350 may be structurally, functionally and/or operationally similar to sensor(s) 250 of knob system 210. Sensor(s) 350 could be actuated by the foregoing actuator rod as discussed above in connection with the third exemplary embodiment. Alternatively or additionally, sensor(s) 350 could be actuated by the ball bearing or other engagement member of ball plunger 384. As such, sensors 350 may be located such that ball plunger 384 and/or the foregoing actuator rod passes over sensor 350 as knob shell 312 is rotated, as would be understood by one skilled in the art. In some embodiments, the foregoing actuator rod could be omitted and sensor(s) 350 could be actuated solely by the engagement member of ball plunger 384.

In operation, a user rotates knob shell 312 with respect to base plate 318. Because detent ring 326 is fixed to knob shell 312, detent ring 226 rotates with knob shell 312. Detent ring 326 further rotates with respect to hub 316. As detent ring 326 rotates, ribs 333 of detent springs 332 become engaged and disengaged with detents 348 formed into hub 316.

Ball plunger 384 also rotates with knob shell 312. As ball plunger 384 rotates with knob shell 312, the engagement member of ball plunger 384 becomes engaged and disengaged with cavities 319 on base plate 318.

Detent springs 332 and detent 348 could be configured to provide a first haptic effect (for example, a major or minor detent effect, as discussed above in connection with the second exemplary embodiment) as knob shell 312 is rotated. Similarly, ball plunger 384 and cavities 319 could be configured to provide a second haptic effect (for example, a minor or major detent effect, as discussed above in connection with the second exemplary embodiment) distinguishable from the first haptic effect as knob shell 312 is rotated.

5. Fifth Exemplary Embodiment

A fifth exemplary embodiment is similar to the fourth exemplary embodiment but omits the first detent mechanism, namely, detent springs 332 and/or detents 348. In embodiments wherein the bearing retainers depend directly from the knob shell, the detent ring can be omitted, as well.

6. Sixth Exemplary Embodiment

Figure 17:
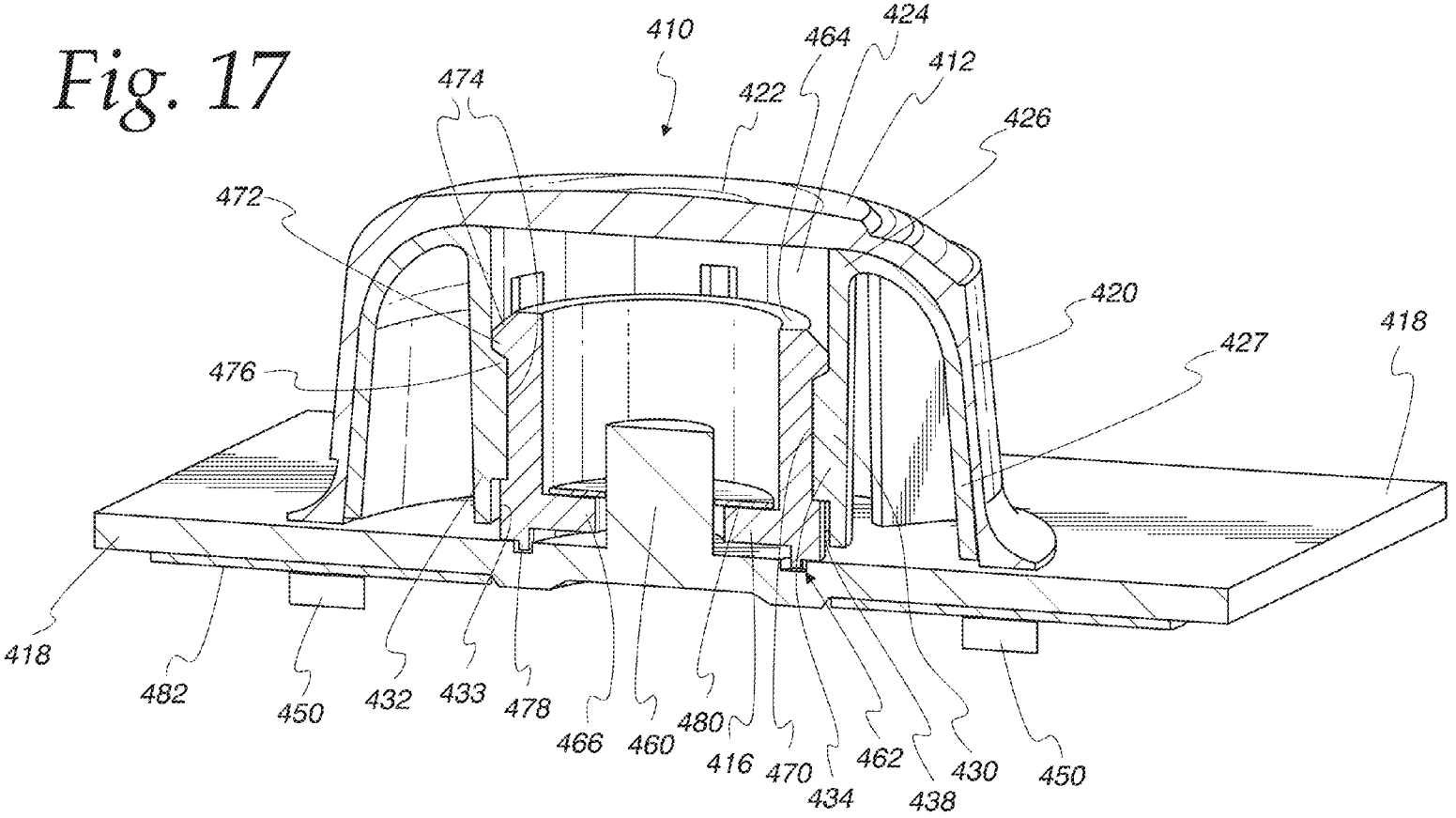
FIG. 17 is a cross-sectional perspective view of a sixth exemplary embodiment of a modular knob system 410.
Figure 18:
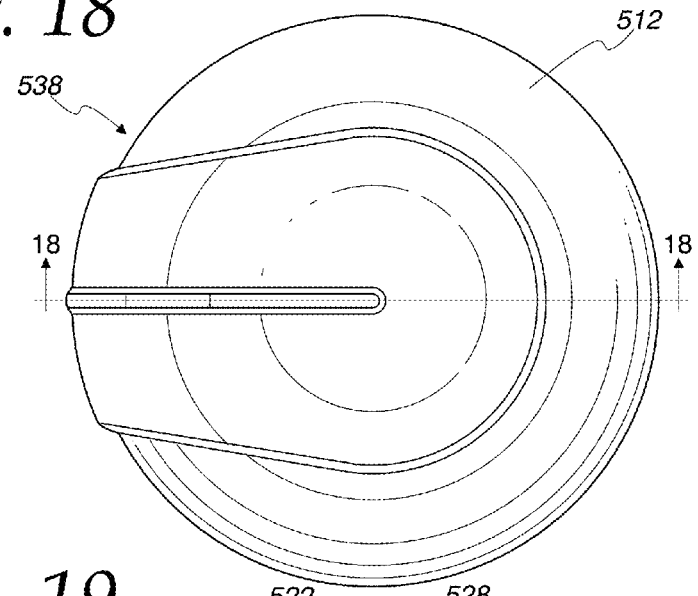
FIG. 18 is a top plan view of a seventh exemplary embodiment of a modular knob system 510.
Figure 19:
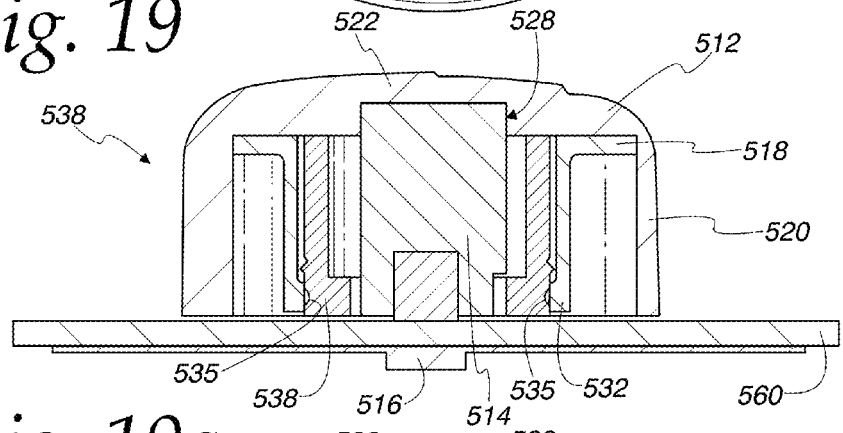
FIG. 19 is a cross-sectional side elevation view of modular knob system 510.
Figure 19A:
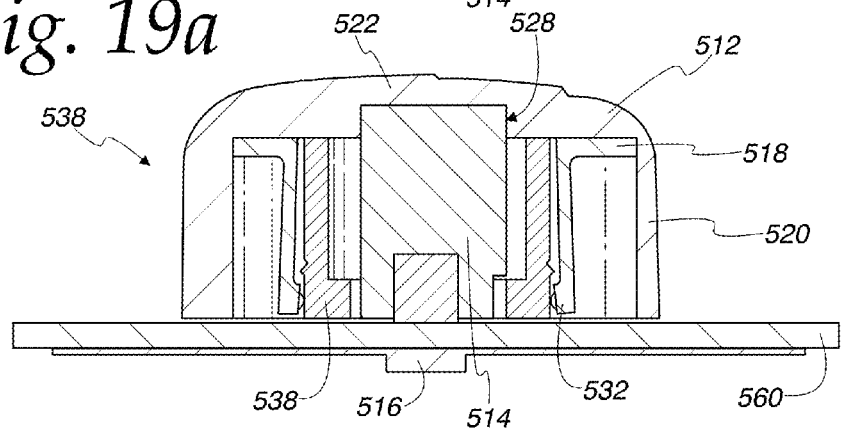
FIG. 19A is another cross-sectional side elevation view of modular knob system 510.
Figure 20:
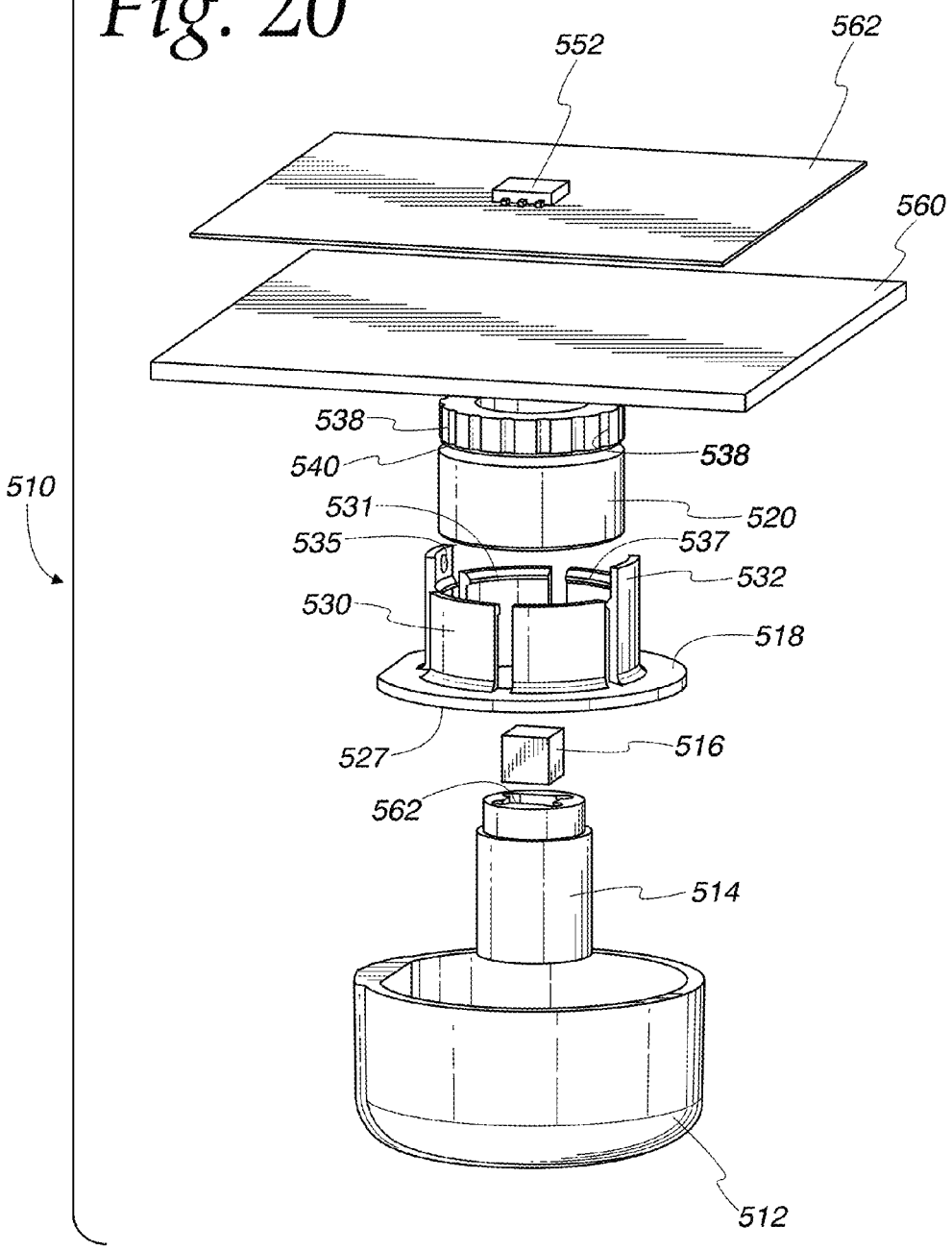
FIG. 20 is an exploded perspective view of modular knob system 510.

FIG. 17 illustrates a sixth exemplary embodiment of a modular knob system 410. Knob system 410 includes a knob shell 412, a knob cage 426, a hub 416, and a base plate 418. Knob system 410 is similar in most respects to knob system 210. Knob system 410, however, does not include a roller bearing, as does knob system 210.

Knob shell 412 is similar to knob shell 212. Knob shell 412 includes an annular portion or sidewall 420 similar to annular sidewall 220, and a cap 422 similar to cap 222. Sidewall 420 and cap 422 cooperate to define a cavity 424. At least one cylindrical recess (not shown) similar to recess 234 may be formed into sidewall 420. An actuator rod and biasing spring (not shown) similar to actuator rod 214 and biasing spring 215 may be disposed with the foregoing recess.

Knob cage 426 is disposed within cavity 424. Knob cage 426 includes a peripheral portion 427 that generally conforms to the interior surface of sidewall 420 of knob shell 412. Hub retainers 430 and detent springs 432 depend from an upper portion of knob cage 426 toward and generally perpendicular to base plate 418. Together, hub retainers 430 and detent springs 432 generally define a portion of an annular ring that generally conforms to the outer circumferential surface of hub 416.

Knob cage 426 may be joined to knob shell 412 by means of an interference fit, or it may be slip fit within knob shell 412 and adhered thereto using an adhesive. Knob cage 426 may be joined to knob shell 412 in other manners, as well.

The surface of hub retainers 230 facing hub 416 includes a inwardly projecting portion 434 configured to releasably engage with a corresponding recessed portion of hub 416, as will be discussed further below. The illustrated embodiment includes four substantially quarter-annular hub retainers 430. Other embodiments could include more or fewer hub retainers 430, each of which would be, respectively, less or more than quarter-annular in extent, as would be understood by one skilled in the art.

Detent springs 432 are flexibly resilient such that they can be flexed outwardly towards sidewall 420 in response to a biasing force applied laterally thereto, and return toward their original positions upon release of the biasing force. The inner surface of detent springs 432 facing hub 416 and proximate the free ends of detent springs 432 are configured to engage with detents 438 formed into the circumferential surface of hub 416, as will be discussed further below. As illustrated, detent springs 432 have a generally arcuate cross-section, with a rib 433 disposed on the interior surface near the free end thereof. Rib 433 is configured for engagement with the foregoing detents, as will be discussed further below. Detent springs 432 may have an inwardly projecting portion similar to inwardly projection portion 434 of hub retainers 430. Such inwardly projecting portion could engage with recessed portion 470 of hub 416 and thereby assist in retaining knob cage 426 to hub 416. Alternatively, detent springs 432 could have other forms, as would be understood by one skilled in the art.

Base plate 418 includes a retainer post 460. Retainer post 460 may be formed integrally with base plate 418 or as a separate, post-attached component. Base plate 418 defines a groove 462 configured to position hub 416 in relation thereto, as will be discussed further below.

Hub 416 includes a generally annular portion or sidewall 464 and a plate portion 466 disposed near a first end of sidewall 464. Sidewall 464 defines a circumferential outer surface. A portion of the circumferential outer surface of hub 416 adjacent base plate 418 defines a detent contour including at least one detent 438 configured to receive the corresponding surface of detent springs 432, for example, rib 433. An intermediate portion of sidewall 464 defines a recessed portion 470. A retaining lip 472 is provided at the end of hub 416 opposite base plate 418. Lip 472 defines a first bevel 474 configured to facilitate assembly of hub retainers 430 to hub 416. Lip 472 also defines a second bevel 476 configured to securely, yet releasably, retain hub retainers 430 to hub 416. A relatively narrow flange 478 extends axially from the end of hub 416. In some embodiments, one or both of the foregoing bevels could be omitted. Flange 478 is configured to be received by groove 462 in base plate 418, thereby registering hub 416 to base plate 418.

Plate portion 466 of hub 416 defines an aperture. The aperture is configured to receive post 460 of base plate 418 there through. A push nut 480 secures hub to base plate 418, as would be understood by one skilled in the art.

One or more sensors 450 may be provided in association with base plate 418. In the illustrated embodiments, two sensors 450 are provided on a circuit carrier 482 attached to base plate 418. Circuit carrier 482 could be embodied in any suitable form, as would be recognized by ones skilled in the art. For example, circuit carrier 482 could be embodied as a printed wiring board, a flexible carrier, or another form of circuit carrier. Sensors 450 could be structurally, functionally and/or operationally similar to the sensors discussed in connection with the previously discussed embodiments, and may be arranged and controlled in any similar manner.

7. Seventh Exemplary Embodiment

Knob system 510 includes a knob shell 512, a magnet post 514, a diametric magnet 516, a bearing ring 518, a bearing hub 520 and a base plate 560. Knob system 510 can be associated with a circuit carrier 524 including a magnetic encoder 552.

Knob shell 512 has a generally annular sidewall 520 and a cap 522 attached to a first end of sidewall 520. Sidewall 520 and cap 522 cooperate to form a cavity. Cap 522 includes a recessed portion 528 extending inwardly from the cavity. Recess 528 is configured to receive an end of a magnet post 514.

Magnet post 514 is illustrated as being generally cylindrical. In other embodiments, magnet post 514 could have other shapes. For example, magnet post 514 may be shaped in a manner that enables keying of magnet post 514 to knob shell 512. In such embodiments, a portion of knob shell 512 (for example, recess 528) could be similarly shaped and configured to receive magnet post 514 in keyed engagement, as would be recognized by one skilled in the art. Magnet post 514 may be attached and keyed to knob shell 512 using any suitable technique, as would be understood by one skilled in the art. An end of magnet post 514 includes a recess 562 having a square cross section for receiving diametric magnet 516 having a complementary cross-section. With knob system 510 in the assembled state, diametric magnet 516 could be in bearing engagement or near-bearing engagement with base plate 560, as would be understood by one skilled in the art.

Bearing ring 518 includes an annular upper ring portion 527 from which hub retainers 530 and detent springs 532 depend. Hub retainers 530 include a lip 531 near the free end thereof. Lip 531 may include bevel features for example, beveled portion 537, similar to the bevel features provided in connection with bearing retainers 230 of knob system 210. Such bevel features may facilitate assembly of bearing ring 518 to hub 520. Such bevel features also may facilitate intentional disassembly of bearing ring from hub while precluding unintentional disassembly of bearing ring 518 from hub 520, as discussed above and as would be recognized by one skilled in the art. Bearing ring 518 may be fixed to knob shell 512 using any suitable technique, including those discussed above in connection with the other embodiments, as would be understood by one skilled in the art.

Bearing hub 520 is generally annular. A portion of the outer surface of bearing hub 520 proximate the end thereof proximate base plate 560 defines a detent contour including one or more detents 538. The portion of the outer surface of bearing hub 520 proximate the other end thereof is generally smooth to permit rotation of bearing ring 518 with respect to hub 520. (When knob system 510 is assembled, this smooth surface of bearing hub 520 is in bearing engagement with the inner surface of bearing ring 518.) A groove 540 or similar relief is provided between the smooth outer surface of bearing hub 520 and the detent contour 538. Groove 540 is configured to receive lip 531 of bearing ring 518. Bearing hub 520 is attached to base plate 560 using any suitable means as would be understood by one skilled in the art. In some embodiments, bearing hub 520 could be integrally formed with base plate 560.

Encoder 552 is associated with the other side of base plate 560. In the illustrated embodiment, encoder 552 is disposed on a circuit carrier 524 attached to base plate 560. In other embodiments, encoder 552 could be disposed directly on base plate 560. Encoder 552 could be electrically connected to related electrical circuitry disposed on circuit carrier 524 or base plate 560.

In operation, a user could rotate knob shell 512. Because bearing ring 518 is fixed to knob shell 512, and magnet post 514 is keyed to knob shell 512, bearing ring 514 and magnet post 516 would rotate with knob shell 512. As bearing ring 514 rotates, detent springs 532 alternately engage and disengage with detents 538, thereby providing haptic effect to the user. Also, as magnet post 514 rotates, diametric magnet 516 rotates. Encoder 552 detects the rotation of diametric magnet 516 as knob shell 512 is rotated and can provide a corresponding output to an external control circuit or device (not shown), as would be understood by one skilled in the art. Encoder 552 typically could determine the direction and degree of rotation of magnet 516 and, therefore, knob shell 512, as well as its absolute position, once initialized, as would be understood by one skilled in the art.

Terms such as upper, lower, top, bottom, front, rear, forward, rearward, horizontal, vertical and others suggesting relative spatial orientation are used herein for ease of illustration and are not intended to limit the absolute spatial orientation of features or structures they refer to.

Although certain exemplary embodiments are illustrated and discussed herein, they should not be deemed to limit the scope of the invention as set forth in the claims. Further, one skilled in the art would understand that features discussed above in connection with any of the exemplary embodiments could be combined with features of the other exemplary embodiments to the extent possible.

The invention claimed is:

1. A modular knob system comprising:

a base plate having a first surface and a second surface;

a magnetic encoder disposed on said first surface of said base plate or on a circuit carrier disposed on said first surface of said base plate;

an annular hub fixedly disposed on said second surface of said base plate, said hub comprising a first portion having a smooth outer surface, a second portion defining a detent contour, and a circumferential groove between said first portion and said second portion;

a bearing ring rotatably disposed about said hub, said bearing ring comprising an annular ring portion, a detent spring depending from said annular ring portion, and a retainer depending from said annular ring portion, said detent spring engaged with said detent contour and said retainer in bearing engagement with said smooth outer surface, said retainer comprising a lip engaged with said groove;

a knob shell keyed to said bearing ring;

a magnet post keyed to said knob shell; and a diametric magnet keyed to said magnet post and overlying said magnetic encoder;

wherein said magnetic encoder detects rotation of said diametric magnet in response to rotation of said knob shell; and wherein said detent spring alternately engages and disengages with detents in said detent contour when said knob is rotated to provide haptic feedback to a user.

2. The modular knob system of claim 1 wherein said detent contour is defined by an outer surface of said annular hub comprising first arcuate portions having a relatively great diameter and alternating second arcuate portions having a relatively small diameter.

3. The modular knob system of claim 1 wherein a free end of said detent spring flexes radially when said detent spring engages and disengages with said detents in response to said rotation of said knob.

4. A modular knob system comprising:

a base plate having a first surface and a second surface;

a magnetic encoder disposed on said first surface of said base plate or on a circuit carrier disposed on said first surface of said base plate;

a hub fixedly disposed on said second surface of said base plate, said hub comprising a first portion having a smooth outer surface and a second portion defining a detent contour;

a bearing ring rotatably disposed about said hub, said bearing ring comprising a detent spring and a retainer, said detent spring engaged with said detent contour and said retainer in bearing engagement with said smooth outer surface;

a knob shell non-rotatably engaged with said bearing ring;

a magnet post non-rotatably engaged with said knob shell; and a magnet non-rotatably engaged with said magnet post and overlying said magnetic encoder;

wherein said magnetic encoder detects rotation of said magnet in response to rotation of said knob shell; and wherein said detent spring alternately engages and disengages with detents in said detent contour when said knob is rotated to provide haptic feedback to a user.

5. The modular knob system of claim 4, said hub further comprising a circumferential groove between said first portion and said second portion.

6. The modular knob system of claim 4, said retainer comprising a lip engaged with said groove.

7. The modular knob system of claim 6 wherein said lip comprises a beveled portion configured to facilitate assembly of said bearing ring to said hub and to preclude unintentional disassembly of said bearing ring from said hub.

8. The modular knob system of claim 4, said detent ring comprising an annular ring portion, said detent spring and said retainer depending from said annular ring portion.

9. The modular knob system of claim 4 wherein said magnet is a diametric magnet.

10. The modular knob system of claim 4 wherein said hub is generally annular.

11. The modular knob system of claim 4 wherein said hub is attached to said base plate.

12. The modular knob system of claim 4 wherein said hub is integrally formed with said base plate.

13. The modular knob system of claim 4, said bearing ring comprising a plurality of retainers and/or a plurality of detent springs.

14. The modular knob system of claim 4, said magnet in bearing engagement with said base plate.

15. The modular knob system of claim 4 wherein said detent contour is defined by an outer surface of said hub comprising first arcuate portions having a relatively great diameter and alternating second arcuate portions having a relatively small diameter.

16. The modular knob system of claim 4 wherein a free end of said detent spring flexes radially when said detent spring engages and disengages with said detents in response to said rotation of said knob.

* * * * *